US011406173B2

(12) United States Patent
Serposi

(10) Patent No.: US 11,406,173 B2
(45) Date of Patent: Aug. 9, 2022

(54) BRUSH FOR THE APPLICATION OF FLUID PRODUCTS, PARTICULARLY FOR POWDERY, CREAMY, LIQUID PRODUCTS OR THE LIKE

(71) Applicant: PENNELLI FARO S.R.L., Casalmaggiore (IT)

(72) Inventor: Gianluca Serposi, Casalmaggiore (IT)

(73) Assignee: Pennelli Faro S.r.l., Casalmaggiore (IT)

( * ) Notice: Subject to any disclaimer, the term of this patent is extended or adjusted under 35 U.S.C. 154(b) by 369 days.

(21) Appl. No.: 16/320,454

(22) PCT Filed: Jun. 30, 2017

(86) PCT No.: PCT/IB2017/053978

§ 371 (c)(1),
(2) Date: Jan. 24, 2019

(87) PCT Pub. No.: WO2018/020341

PCT Pub. Date: Feb. 1, 2018

(65) Prior Publication Data

US 2019/0261766 A1 Aug. 29, 2019

(30) Foreign Application Priority Data

Jul. 25, 2016 (IT) ..... 201600077961

(51) Int. Cl.

| | |
|---|---|
| ***A45D 40/26*** | (2006.01) |
| ***A46B 9/04*** | (2006.01) |
| ***A46B 5/00*** | (2006.01) |
| ***A45D 33/36*** | (2006.01) |
| ***A45D 34/04*** | (2006.01) |

(Continued)

(52) U.S. Cl.

CPC ..... *A46B 5/0029* (2013.01); *A45D 33/34* (2013.01); *A45D 33/36* (2013.01); *A45D 34/042* (2013.01); *A45D 40/262* (2013.01); *A46B 3/02* (2013.01); *A46B 5/00* (2013.01); *A46B 5/0037* (2013.01); *A46B 5/021* (2013.01); *A46B 5/04* (2013.01);

(Continued)

(58) Field of Classification Search

CPC .... A46B 9/04; A46B 2200/1046; A45D 40/26
See application file for complete search history.

(56) References Cited

U.S. PATENT DOCUMENTS 3,647,305 A 3/1972 Baker et al.
4,698,871 A * 10/1987 Patkos ..... A45D 33/34 15/118

(Continued)

FOREIGN PATENT DOCUMENTS

JP 2001029129 A 2/2001
JP 2012019828 A 2/2012

(Continued)

*Primary Examiner* — Michael D Jennings
(74) *Attorney, Agent, or Firm* — David B. Tingey; Bryant J. Keller; Kirton McConkie

(57) ABSTRACT

The brush for the application of fluid products, particularly for powdery, creamy, liquid products or the like, comprises a plurality of spreading elements to spread a fluid product on a work surface and having a first ending part associated with a support element and a second free ending part, opposite to the first ending part and adapted to take and apply the product, in which the support element is made of a flexible material.

9 Claims, 4 Drawing Sheets

(51) Int. Cl.

| | |
|---|---|
| ***A46B 3/02*** | (2006.01) |
| ***A46B 5/02*** | (2006.01) |
| ***A46B 9/02*** | (2006.01) |
| ***A45D 33/34*** | (2006.01) |
| ***A46B 5/04*** | (2006.01) |

(52) U.S. Cl.
CPC ..... *A46B 9/021* (2013.01); *A46B 2200/1046* (2013.01)

(56) References Cited

U.S. PATENT DOCUMENTS

| | | | | |
|---|---|---|---|---|
| 6,006,761 | A * | 12/1999 | Meledandri | A45D 33/34 132/317 |
| 7,036,179 | B1 * | 5/2006 | Weihrauch | A46B 7/06 15/167.1 |
| 8,607,398 | B2 * | 12/2013 | Zahoransky | A46D 3/05 15/206 |
| 8,777,503 | B2 * | 7/2014 | Gueret | A46B 9/021 401/129 |
| 8,944,714 | B2 * | 2/2015 | Gueret | A45D 40/265 401/129 |
| 2003/0178043 | A1 * | 9/2003 | Gueret | A46B 7/02 132/313 |
| 2007/0045135 | A1 | 3/2007 | Sharp et al. | |

FOREIGN PATENT DOCUMENTS

| | | | |
|---|---|---|---|
| KR | 20150071599 | A | 6/2015 |
| KR | 20150109137 | A | 10/2015 |

* cited by examiner

Fig.9
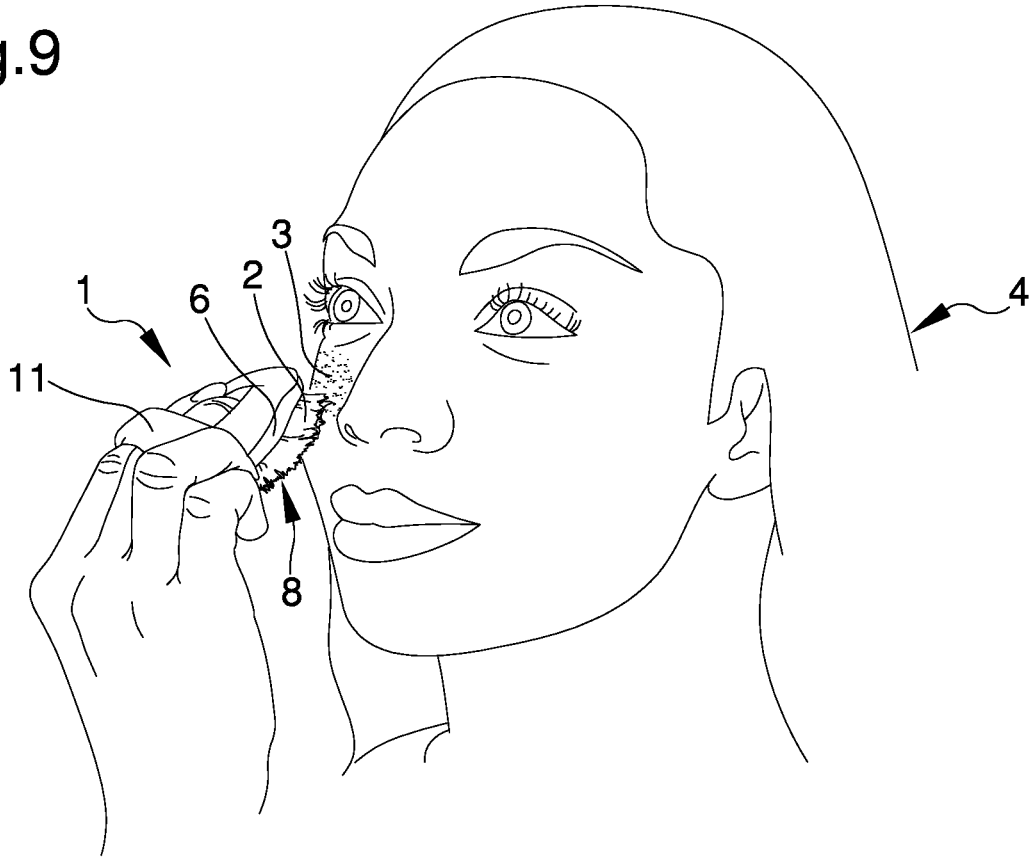
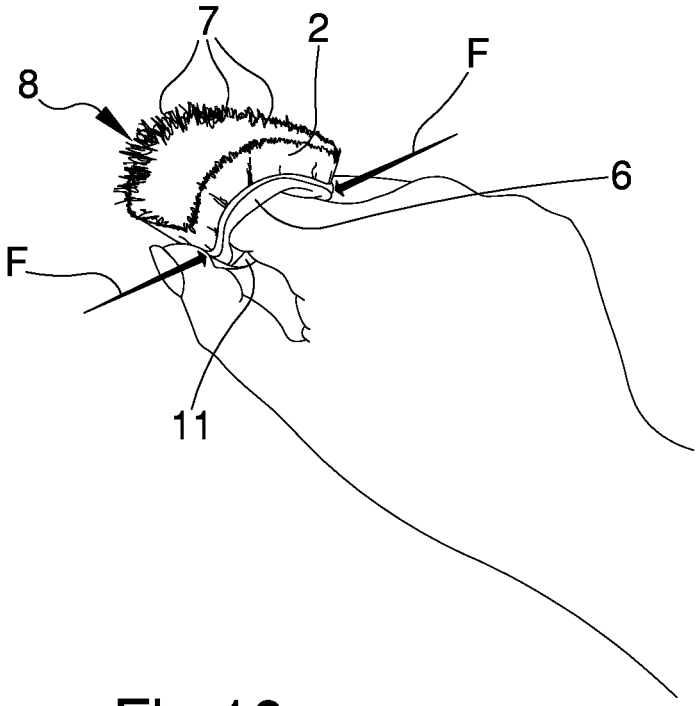
Fig.10

BRUSH FOR THE APPLICATION OF FLUID PRODUCTS, PARTICULARLY FOR POWDERY, CREAMY, LIQUID PRODUCTS OR THE LIKE

TECHNICAL FIELD

The present invention relates to a brush for the application of fluid products, particularly for powdery, creamy, liquid products or the like.

BACKGROUND ART

With particular but not exclusive reference to the cosmetic sector, various types of brush are known which differ both in shape and size, to be used according to the type of application and the aesthetic result one wishes to obtain.

Generally, all the brushes have a grip body particularly suited to be grasped and held by a user.

In a first type of brushes, the grip body, usually elongated, comprises an ending part provided with a special cavity defining a housing seat adapted to accommodate a plurality of spreading elements, generally natural hair or synthetic bristles, forming the brush head, that is, the part of the latter adapted to take the cosmetic product and apply it on the portions of the skin to make up.

The housing seat can be formed directly onto the grip body or, alternatively, assembled to the grip body itself.

In this case, the housing seat is usually referred to as a ring nut.

The plurality of hair/bristles is partly inserted into the housing seat so as to be enclosed by the ending part of the grip body and retained therein by means of glue or other adhesive substances.

The portion of hair/bristles coming out of the housing seat, depending on the shape of the latter and on the insertion technique, gives the application body different conformations depending on the type of brush.

In this case, each hair/bristle has a first ending part retained inside the housing seat and a second free ending part protruding from the housing seat itself so that it can be used to take and apply the cosmetic product.

In more detail, polymerization of the adhesive substances, generally resin-based, results in the retention of the first ending part inside the housing seat and the formation of a monolithic base body locked to measure inside the cavity.

After solidification has occurred, the base body is only deformable by applying external forces which deform it irreversibly, thus preventing users from modifying the conformation of the relevant application body according to their specific requirements.

In other cases, the application of external forces onto the base body causes it to break, resulting in the loss of the brush functionality with the relevant replacement costs to be borne.

It is easy to understand that the base body and, at the same time, the application body are unsuitable to the facial features of the user's face.

In fact, in order to cope with the need to vary the shape of the application body, for example to perform precision applications, or to spread the cosmetic product over a large surface, it is necessary to use a multitude of brushes that lengthens the operations and jeopardizes the final result.

In this regard, the need is also known to simplify and speed up the application operations of the cosmetic products without having to give up satisfactory final results.

In order to overcome the aforementioned drawbacks at least partially, a second type of brush is known having the application body associated with the relevant housing seat positioned on a partially flexible grip body.

Nevertheless, also in this case, the application body is associated with the housing seat by interposition of adhesive substances which, once solidified, prevent the same from deforming.

In other words, the flexibility of the grip body allows adapting the inclination of the application body to the user's face without permitting its deformation depending on the variation of the facial features.

The adaptability of the application body is due to the flexibility of the grip body which, however, allows the movement thereof as a single monolithic body, without altering the conformation that remains the same irrespective of the shape and the inclination of the surfaces to which it comes in contact.

In fact, even in this case, in order to cope with the variability of cosmetic applications, it is necessary to use a multitude of brushes, thus complicating the application and distribution operations of the cosmetic product and resulting in an increase in the time required to carry out these operations.

DESCRIPTION OF THE INVENTION

The main aim of the present invention is to provide a brush for the application of fluid products, particularly for powdery, creamy, liquid products or the like, enabling to carry out rapid and precise application operations of the cosmetic products, by varying the shape of the application body according to the specific users' needs and to the conformation of the areas to make up.

One object of the present invention is to provide a brush for the application of fluid products, particularly for powdery, creamy, liquid products or the like, which allows the formation of application surfaces in an instant manner, greatly reducing the operational times required for the make-up.

Another object of the present invention is to provide a brush for the application of fluid products, particularly for powdery, creamy, liquid products or the like, which allows to overcome the aforementioned drawbacks of the prior art within the ambit of a simple, rational, easy, efficient to use and cost-effective solution.

The aforementioned objects are achieved by this brush for the application of fluid products, particularly for powdery, creamy, liquid products or the like having the characteristics of claim 1.

BRIEF DESCRIPTION OF THE DRAWINGS

Other characteristics and advantages of the present invention will become more evident from the description of a preferred, but not exclusive, embodiment of a brush for the application of fluid products, particularly for powdery, creamy, liquid products or the like, illustrated by way of an indicative, but non-limiting example, in the attached drawings in which:

FIGS. 9-12 are schematic representations of the brush according to the invention during use.

Embodiments of the Invention

Figure 1:
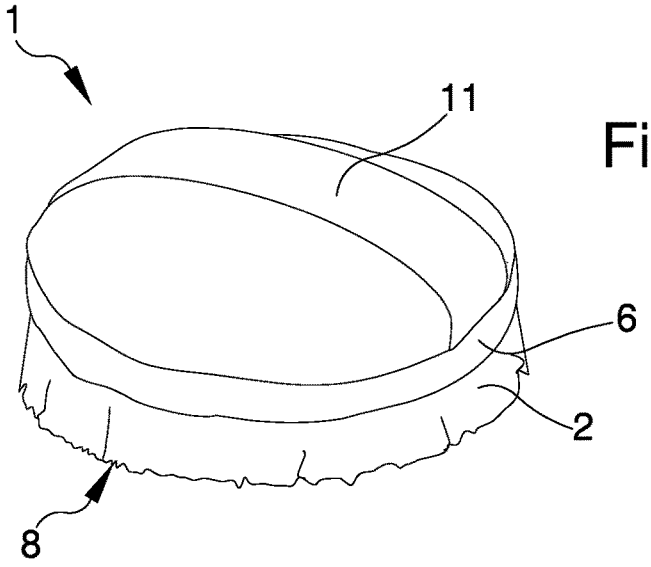
FIG. 1 is an axonometric view of the brush according to the invention.
Figure 2:
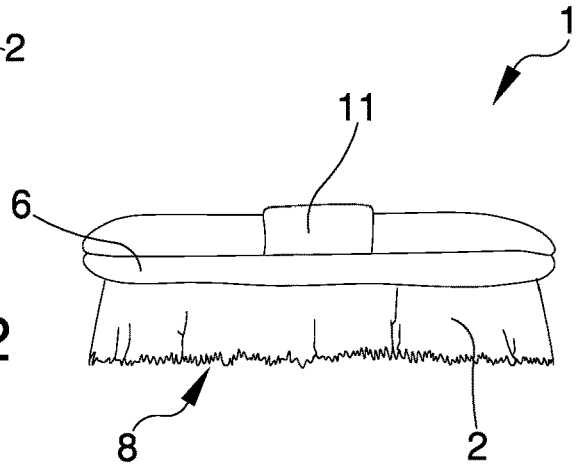
FIG. 2 is a front view of the brush according to the invention.
Figure 3:
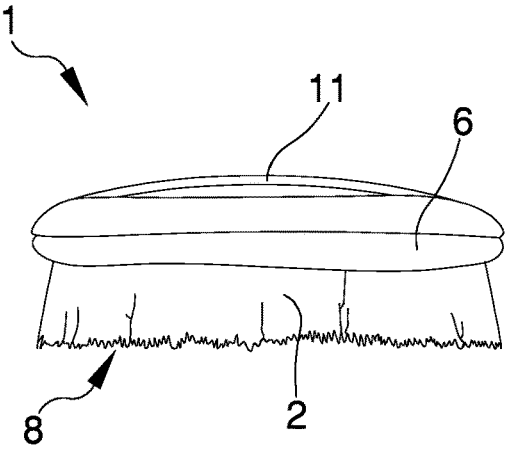
FIG. 3 is a side view of the brush according to the invention.
Figure 4:
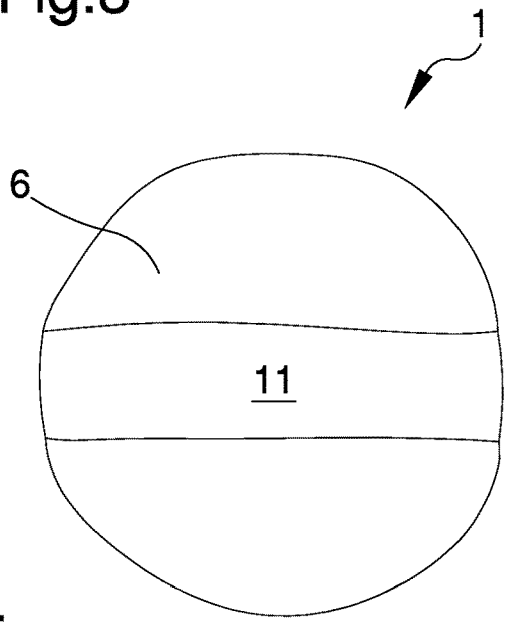
FIG. 4 is a top view of the brush according to the invention.

With particular reference to these figures, reference numeral 1 globally indicates a brush for the application of cosmetic products.

The brush 1 comprises a plurality of spreading elements 2 to spread a fluid product 3 on a work surface 4.

Preferably, the spreading elements 2 are made of synthetic yarn, polymeric material, or other material adapted to take and spread the products intended to treat and make up the skin of the user 4.

Advantageously, the spreading elements 2 are made of a natural and/or syntactical hair type.

It is useful to point out that, within the scope of this discussion, by "fluid product" is meant any substance suitable to be taken, applied and spread using the brush 1 such as e.g. powders, creams and liquids in the cosmetic, artistic, food and industrial field.

For example, the brush 1 is usable in the textile or footwear sector to treat the work surface 4.

Furthermore, by "work surface" is meant any surface adapted to be spread, covered, or treated by the aforementioned product, such as e.g. a portion of human skin, a manufactured article, a building surface, food and the like.

In the present case, with particular reference to the cosmetic sector, by the term "work surface" is meant a portion of the skin of a user 4 and, at the same time, by product 3 is meant a cosmetic product.

Finally, it is specified that the term "user" refers to the person intended to use the cosmetic product 3, who does not necessarily coincide with the person using the brush 1.

It is further specified that by "cosmetic product" 3 it is meant every substance, or mixture of substances, to be applied on external surfaces of the human body, with the exclusive scope, or with the main scope, to modify the exterior look, clean said surfaces, perfume, protect and keep them is a good state or correct its scents.

The spreading elements 2 have a first ending part 5 associated with a support element 6 and a second free ending part 7, opposite to the first ending part 5 and adapted to take and apply the cosmetic product 3.

The spreading elements 2 associated with the support element 6 define an application body 8 of the cosmetic product 3.

More specifically, the spreading elements 2 present an elongated conformation.

In detail, the spreading elements 2 extend from the support element 6 along a longitudinal developing direction, transversal in respect the support element itself.

In other words, the spreading elements 2 develop substantially in a vertical way, starting from the support element 6.

That means that the portion of the spreading elements 2 that extends unilaterally from the support element 6 defines the application body 8 that is the part of the latter suitable to take and apply the cosmetic product 3.

Usefully, the spreading elements 2 extend from the support element 6 for at least ¼ of their length.

Preferably, the spreading elements 2 extend from the support element 6 for at least ½ of their length.

Usefully, the spreading elements 2 extend from the support element 6 for at least ¾ of their length.

According to the invention, the support element 6 is made of a flexible material. With reference to the particular embodiments illustrated in the figures, the support element 6 has a circular shape.

It is specified that the shape and extension of the support element 6 are variable according to the specific requirements of the technicians expert in the field; in this regard it cannot be ruled out that the extension of the support element 6 is such as to cover the face of the user 4.

The support element 6 is elastically deformable.

This means that in the presence of external stresses, the support element 6 deforms by defining application surfaces which are available for taking and applying the cosmetic product 3 onto the user 4, and in the absence of said external stresses, the support element 6 returns to its initial shape.

In particular, the flexible material, i.e. the manufacturing material of the support element 6, has a modulus of elasticity comprised between 0.001 GPa and 0.15 GPa.

Figure 11:
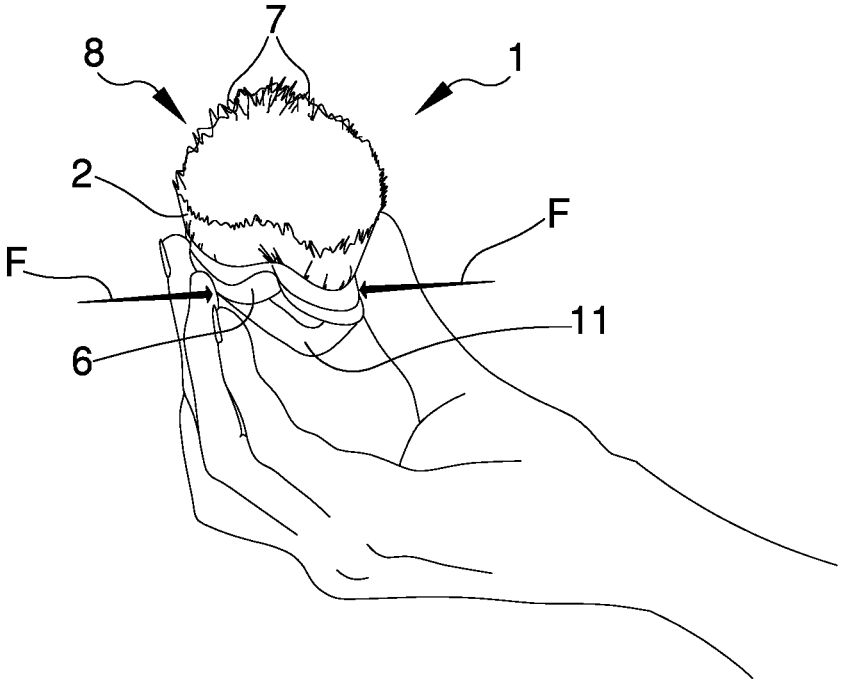
Figure 12:
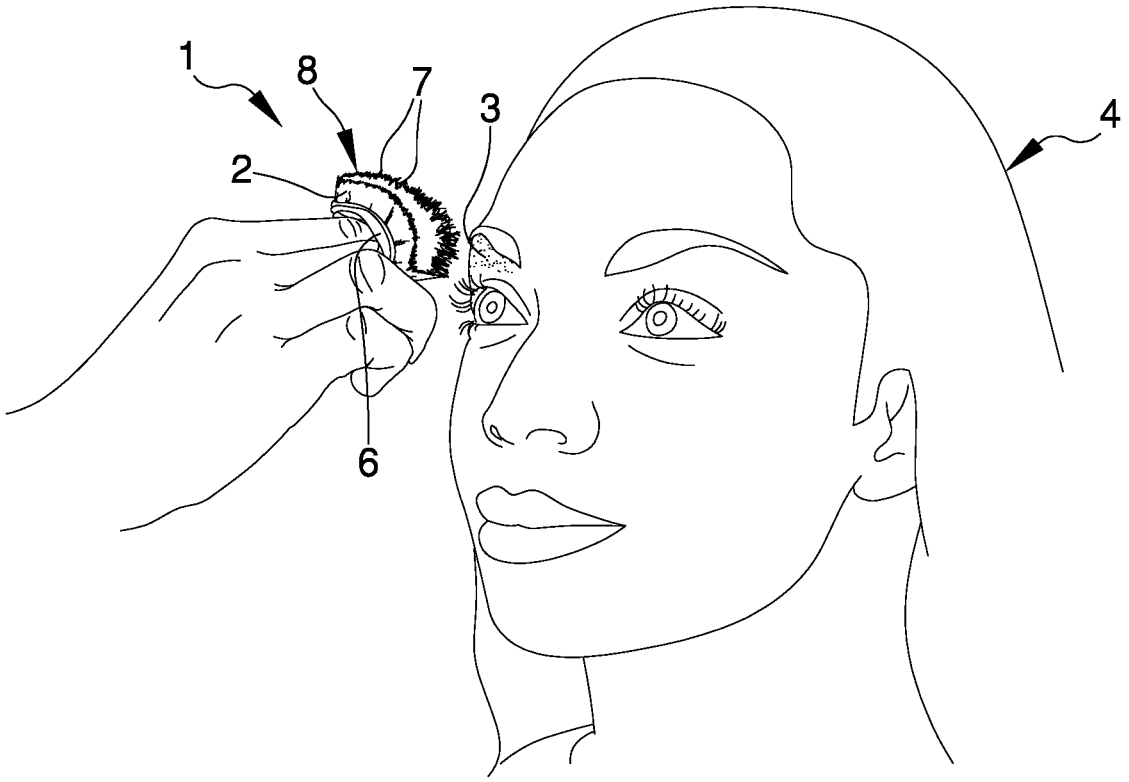

In this regard, the support element 6 is deformable, by effect of an external force schematically illustrated in FIG. 11 by the arrows F, between at least a first configuration of use (FIGS. 1-5, 9) in which the support element 6 is extended and lies on a substantially horizontal plane, and at least a second configuration of use (FIGS. 10-12) in which the support element 6 is folded at least partly on itself.

In the first configuration of use, the entire surface extension of the application body 8 is available for the application of the cosmetic product 3, in the same way, in the second configuration of use, the deformation of the support element 6 causes a corresponding deformation of the application body 8 such as to form, for example, a protruding or recessed portion, which is adapted to allow for precision applications of the cosmetic product 3.

In this case, the direction of application of the forces F varies according to the methods of application of the cosmetic product 3 and to the extent of the skin portions of the user 4 to be covered with the cosmetic product itself.

Furthermore, the deformability of the support element 6 ensures the deformation of the application body 8 according to the direction of application of the force F and to the extent of the latter.

Figure 5:
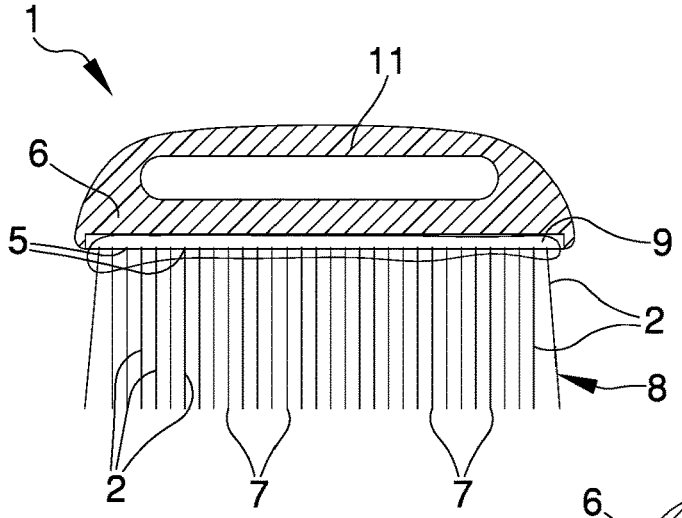
FIG. 5 is a sectional view of the brush of FIG. 1.

In this regard, with reference to a first embodiment shown in FIG. 5, the spreading elements 2 are associated with the support element 6 by interposition of a layer of adhesive material 9 of the flexible type.

The presence of the layer of adhesive material 9 which is also flexible, and therefore deformable, allows the deformation to pass from the support element 6 to the application body 8.

Figure 6:
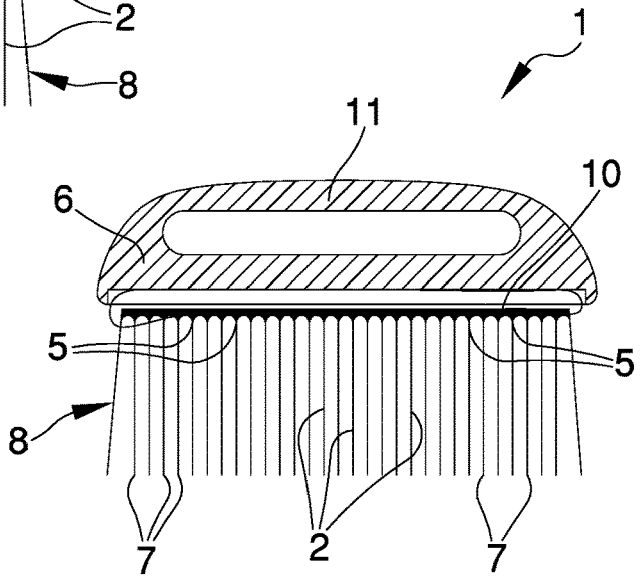
FIG. 6 is a sectional view of the brush according to the invention in a second embodiment.

In the same way, in a second embodiment shown in FIG. 6, the spreading elements 2 have the first ending parts 5 which are integrally associated with one another to define an attachment surface 10 to the support element 6.

Preferably, the spreading elements 2 are heat sealed to one another.

In particular, the attachment surface 10 is associated with the support element 6 by interposition of the layer of adhesive material 9.

Figure 7:
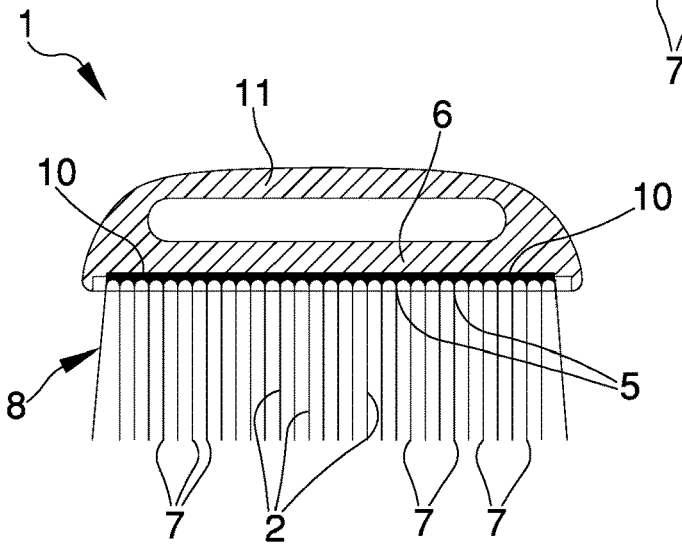
FIG. 7 is a sectional view of the brush according to the invention in a third embodiment.

Alternatively, in a third embodiment shown in FIG. 7, the support element 6 is formed onto the attachment surface 10.

In other words, the support element 6 and the attachment surface 10 with the relevant spreading elements 2 can be made separately, by means of molding techniques such as e.g. injection molding, compression molding, and subsequently assembled together, or, alternatively, they can be made in a single monolithic body piece.

Alternative molding techniques cannot also be ruled out wherein the support element 6 is cast or co-injected onto the attachment surface 10.

Figure 8:
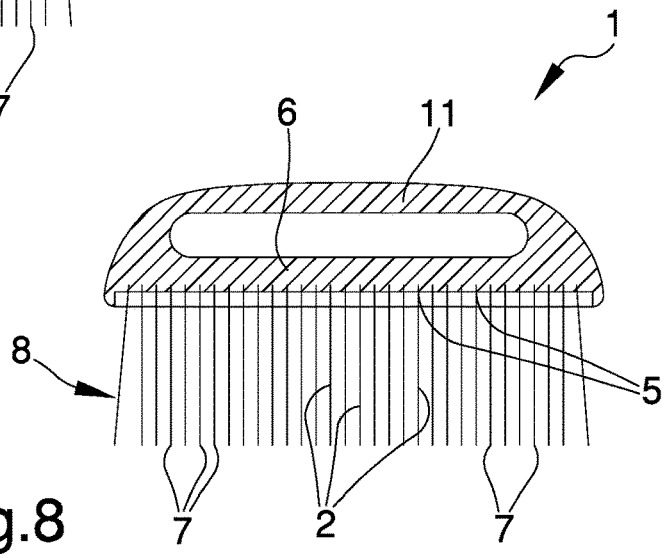
FIG. 8 is a sectional view of the brush according to the invention in a fourth embodiment.

Furthermore, with reference to a fourth embodiment shown in FIG. 8, the spreading elements 2 and the support element 6 are made in the same material.

In this case, the support element 6 is made by molding on the loose spreading elements 2, i.e. separated from one another.

Alternative embodiments cannot however be ruled out wherein the support element 6 is plastically deformable.

In this case, contrary to the elastic deformation, in the presence of external stresses the support element 6, by deforming, varies its shape permanently even when said stresses stop.

The easy handling and movement of the brush 1 is facilitated by the fact that the support element 6 is associable with a grip element 11.

In the figures, by way of example only, a grip element 11 is shown of the type of a handle.

Advantageously, the grip element 11 is associated with the support element 6 onto a portion of the latter opposite to the application body 8.

Moreover, alternative embodiments cannot be ruled out wherein the grip element 11 and the support element 6 are made in a single monolithic body.

Before the detailed description of the functioning of the present invention and its particular structural features, it is good to underline that the flexibility of the support elements 6 allows the realization of application faces and angles always different in function of specific needs of the user.

To that, it is added the fact of presenting spreading elements with a elongated conformation and the type of hair type allows the application of fluid products, that are powdery, creamy, liquid, maintaining untouched the efficiency of the application, together with the precision and accuracy.

The combination of said characteristics allows realizing technical effects that are completely different with respect to the ones described in documents JP2012019828, U.S. Pat. No. 6,006,761, JP2001029129, KR20150071599, U.S. Pat. Nos. 4,698,871, 7,036,179, US2003/178043, US2007/04515.

More specifically, none of the above-mentioned documents allow the realization of esthetical effects that differ in function of the faces of application realized following the deformation of the application body 8.

To that, it is added that the synergic combination of the deformability of the application body 8 together with the presence of spreading elements 2 with a elongated conformation allows to perform a indistinct application and with an unchanged precision and accuracy of every type of products and on every type of surface to be treated.

The operation of the present invention is as follows.

Depending on the type of surface 4 onto which the cosmetic product 3 is to be applied, the flexibility of the support element 6 allows the application body 8 to follow its trend, either planar, in which case a flat shape is advantageous (FIG. 9), or convex or concave, in which cases a non-planar, protruding (FIG. 10) or recessed shape is, on the contrary, advantageous.

In detail, the brush 1 is maneuvered through the grip element 11 and approached to the cosmetic product 3 contained in the respective containers.

The application body 8 is placed in contact with the area to make up and maneuvered so as to spread the cosmetic product 3 on the area concerned.

In particular, the support element 6 is deformed by means of the application of forces F so as to provide on the application body 8 a deformed portion defining, for example, a protrusion or a recess adapted to allow the application and the spreading of the cosmetic product 3 by simply maneuvering the brush 1 and passing the aforementioned deformed portion on the area to make up.

It has in practice been found that the described invention achieves the intended objects.

The fact is underlined that the particular solution of providing a support element of the application body made of a deformable material allows the use of the brush in a plurality of different methods of use, thus coping both the need to spread the cosmetic product on large areas, and to apply the latter precisely in areas of reduced size.

Additionally, the total adaptability of the application body makes the invention profitable also in fields other than the cosmetic field, such as e.g. industrial coatings or the fine arts sector, in which it is profitable the use of an adaptable surface able to make the transfer of any material most efficient on any surface using the brush.

The invention claimed is:

1. A cosmetic brush for application of a cosmetic fluid product, particularly for powdery, creamy, liquid products or the like, comprising a plurality of spreading elements to spread said cosmetic fluid product on a work surface and the plurality of spreading elements having a first ending part associated with a support element and a second free ending part, opposite to said first ending part and adapted to take and apply said cosmetic fluid product, wherein said support element comprises a flexible material, wherein said plurality of spreading elements present an elongated conformation extending from said support element along a longitudinal developing direction transverse in respect to said support element itself, wherein said plurality of spreading elements comprise at least one of (i) a natural hair type and (ii) a synthetic hair type, wherein said support element is deformable by effect of an external force exerted on said support element, between:

a first configuration of use in which said support element is extended and lies on a substantially horizontal plane;

a second configuration of use in which said support element is folded at least partly on itself, wherein said plurality of spreading elements define an application body, and wherein said support element is configured to be deformed by means of an application of a force so as to provide on the application body with a deformed portion defining, a protrusion or a recess adapted to allow for the application and spreading of the cosmetic fluid product by maneuvering the cosmetic brush and passing the deformed portion on an area to make up.

2. The cosmetic brush according to claim 1, wherein said plurality of spreading elements are associated with said support element by interposition of a layer of an adhesive material of a flexible type.

3. The cosmetic brush according to claim 2, wherein said flexible material has a modulus of elasticity between 0.001 GPa and 0.15 GPa.

4. The cosmetic brush according to claim 1, wherein said plurality of spreading elements each have said first ending part, which is integrally associated with one another to define an attachment surface to said support element.

5. The cosmetic brush according to claim 4, wherein said support element is formed on said attachment surface.

6. The cosmetic brush according to claim 4, wherein said attachment surface is associated with said support element by interposition of a layer of an adhesive material of a flexible type.

7. The cosmetic brush according to claim 1, wherein said support element is associable with a grip element for movement of said cosmetic brush.

8. The cosmetic brush according to claim 1, wherein said support element is elastically deformable.

9. The cosmetic brush according to claim 1, wherein said support element is plastically deformable.

* * * * *